US005520535A

United States Patent [19]

Heilman et al.

[11] Patent Number: 5,520,535

[45] Date of Patent: May 28, 1996

[54] BURNER APPARATUS

[75] Inventors: Paul W. Heilman; Steven H. Gray; Chris N. Taliaferro, all of Duncan, Okla.

[73] Assignee: Halliburton Company, Duncan, Okla.

[21] Appl. No.: 88,967

[22] Filed: Jul. 7, 1993

[51] Int. Cl.[6] ..... F23Q 7/06

[52] U.S. Cl. ..... 431/263; 431/278; 431/285; 431/353

[58] Field of Search ..... 431/278, 353, 431/349, 263, 285, 258, 350, 284, 281, 280, 279; 60/39, 826; 239/419, 419.5, 423, 416.4, 416.5

[56] References Cited

U.S. PATENT DOCUMENTS

| | | | |
|---|---|---|---|
| 986,663 | 3/1911 | Weintz | 239/416.5 |
| 1,014,496 | 1/1912 | Littleton | 239/416.5 |
| 1,411,182 | 3/1922 | Porter | 431/263 X |
| 1,415,141 | 5/1922 | Bohan | 239/416.4 |
| 1,554,362 | 9/1925 | Metcalfe | 431/263 X |
| 1,712,410 | 5/1929 | Thornton | 431/285 |
| 1,787,632 | 1/1931 | Kreager | 431/263 X |
| 2,204,051 | 6/1940 | Ritts et al. | 431/350 X |
| 2,332,210 | 10/1943 | Frank | 431/263 |
| 2,458,543 | 1/1949 | Urquhart | 431/10 |
| 2,534,363 | 12/1950 | Meincke | 239/419 X |
| 3,324,926 | 6/1967 | Jakobi | 431/187 |
| 3,692,016 | 9/1972 | Stikkers et al. | 431/350 |
| 3,713,794 | 1/1973 | Maher et al. | 62/50.2 |
| 4,044,549 | 8/1977 | Zwick | 60/39.02 |
| 4,138,842 | 2/1979 | Zwick | 60/39.23 |
| 4,171,612 | 10/1979 | Zwick | 60/39.23 |
| 4,201,191 | 5/1980 | Zink et al. | 62/50.2 |
| 4,255,116 | 3/1981 | Zwick | 431/11 |
| 4,373,896 | 2/1983 | Zwick et al. | 431/9 |
| 4,374,637 | 2/1982 | Zwick et al. | 431/183 |
| 4,375,954 | 3/1983 | Trudel | 431/9 |
| 4,439,137 | 3/1984 | Suzuki et al. | 431/8 |
| 4,546,610 | 10/1983 | Zwick | 62/52 |
| 5,112,219 | 5/1992 | Hiemstra | 431/354 |
| 5,215,454 | 6/1993 | Ferramola et al. | 431/2 |
| 5,314,329 | 5/1994 | Lockwood, Jr. | 431/353 X |

FOREIGN PATENT DOCUMENTS

| | | | |
|---|---|---|---|
| 232532 | 4/1925 | United Kingdom | 239/419.5 |

*Primary Examiner*—Carl D. Price

*Attorney, Agent, or Firm*—Stephen R. Christian; Dennis D. Brown

[57] ABSTRACT

A burner apparatus comprising: a liquid fuel discharge means for discharging a liquid fuel; an ignition chamber wherein an ignitable gaseous composition can be ignited to yield an ignited composition; and a gas delivery means for delivering a gaseous, free oxygen source and a combustible gas to the ignition chamber such that the ignitable gaseous composition is provided in the combustion chamber. The ignition chamber is positioned with respect to the liquid fuel discharge means such that, upon leaving the ignition chamber, the ignited gaseous composition will ignite the liquid fuel as the liquid fuel is discharged from the discharge means. Preferably, the gas delivery means includes a conduit through which the free oxygen source is conducted into the ignition chamber. The gas delivery means also preferably includes a passageway, adjacent the exterior of the conduit, through which the combustible gas is conducted into the ignition chamber. The gas delivery passageway preferably substantially surrounds the oxygen source delivery conduit. Additionally, the liquid fuel discharge means preferably discharges the liquid fuel into a combustion chamber substantially having an inverted frusto-conical shape.

12 Claims, 8 Drawing Sheets

BURNER APPARATUS

FIELD OF THE INVENTION

The present invention relates to liquid fuel burners. More particularly, but not by way of limitation, the present invention relates to pilot burner assemblies used in direct-fired nitrogen vaporizers.

BACKGROUND OF THE INVENTION

Direct-fired nitrogen vaporizers have been used, for example, to supply nitrogen for various oil and gas production operations. Such vaporizers commonly burn diesel or similar liquid fuels. In a typical direct-fired nitrogen vaporizer, the hot combustion gas generated by burning the liquid fuel is used to heat and vaporize a high-pressure liquid nitrogen stream.

A typical direct-fired nitrogen vaporizer will include: a burner barrel wherein the liquid fuel is combined with air and is burned; a plurality of burner assemblies positioned in an end wall of the burner barrel; a fan which supplies air to the burner barrel; and a nitrogen tube assembly through which a high-pressure liquid nitrogen stream flows. The high-pressure liquid nitrogen stream flowing through the tube assembly is heated and vaporized by the hot combustion gas flowing from the burner barrel. Each of the burners used in the burner barrel will typically include at least one liquid spray nozzle which is operable for spraying the liquid fuel into the burner barrel and a plurality of air slots extending radially about the periphery of the spray nozzle. The air fan operates to blow air through these air slots and into the burner barrel. The flow of air from the air fan also forces the combustion gas generated in the burner barrel out of the burner barrel and through the nitrogen tube assembly.

The liquid fuel supplied to the burner barrel is ignited using a pilot burner assembly. A pilot burner assembly 2 of the type used heretofore in the art is depicted in FIGS. 1 and 2. Pilot burner assembly 2 is composed of: a combustion chamber assembly 4 having a small diameter cylindrical chamber 6 and a large diameter cylindrical chamber 8; a nozzle holder 10 positionable in small diameter chamber 6 of assembly 4; and a diesel fuel nozzle 12 which is positionable in nozzle holder 10 such that, when nozzle holder 10 is placed in small diameter chamber 6, nozzle 12 is operable for atomizing and spraying diesel fuel into large diameter chamber 8 of assembly 4.

As shown in FIGS. 3–9, nozzle holder 10 is formed from a cylindrical piece having side portions 14, 16, and 18 removed therefrom. When nozzle holder 10 is positioned in small diameter chamber 6 of assembly 4, removed portions 14, 16, and 18 allow air from the vaporizer air fan to flow through small diameter chamber 6 and into the large diameter chamber 8 of assembly 4.

Nozzle holder 10 includes: a diesel fuel passageway 20; an ignition chamber 24 wherein a combustible gas (e.g., propane) is ignited; a combustible gas passageway 26 which communicates with ignition chamber 24; and a threaded spark plug port 28 which communicates with ignition chamber 24. Diesel fuel passageway 20 is completely separate from ignition chamber 24, combustible gas passageway 26, and threaded spark plug port 28. Diesel fuel passageway 20 includes (a) a threaded inlet port 30 for threadedly receiving a diesel fuel supply connection 32 and (b) a threaded outlet port 34 for threadedly receiving diesel fuel nozzle 12. A spark plug 36 is threadedly receivable in spark plug port 28 such that the sparking elements of spark plug 36 extend into ignition chamber 24. Combustible gas passageway 26 includes a threaded inlet port 38; a cylindrical bore 40 adjacent inlet port 38; a tapered threaded bore 42 adjacent cylindrical bore 40; and a small diameter cylindrical bore 44 extending from threaded bore 42 to the inlet 46 of ignition chamber 24. The inlet 46 of ignition chamber 24 has an inverted frusto-conical shape which diverges away from small diameter cylindrical bore 44. The remainder of ignition chamber 24 has a substantially cylindrical shape.

A gas nozzle 50 is threadedly receivable in the inlet port 38 of gas passageway 26 for delivering a combustible gas to passageway 26 and to ignition chamber 24. An orifice 52 for metering the rate of gas flow into ignition chamber 24 is threadedly received in small diameter bore 44 of gas passageway 26.

Combustion chamber assembly 4 is connectable to the end wall of a nitrogen vaporizer burner chamber using bolts 54. An aperture 56 is provided in the wall of small diameter cylindrical chamber 6 of assembly 4 for receiving spark plug 36 and allowing spark plug 36 to be threadedly connected in spark plug port 28 of nozzle holder 10. When positioned in aperture 56 and in threaded spark plug port 28, spark plug 36 operates to prevent nozzle holder 10 from falling or being pushed from small diameter chamber 6 into large diameter chamber 8 of combustion chamber assembly 4.

In operation, propane or some other combustible gas is delivered to ignition chamber 24 of pilot burner assembly 2 via gas nozzle 50, gas passageway 26, and orifice 52. In ignition chamber 24, the combustible gas is combined with air and is ignited by spark plug 36. The air needed for ignition in ignition chamber 24 enters the ignition chamber via ignition chamber opening 58. Air enters opening 58 as a result of turbulence created in the vaporizer burner barrel due to the operation of the vaporizer air fan.

At the same time that the air/combustible gas mixture is being ignited in ignition chamber 24, diesel fuel is delivered to large diameter cylindrical chamber 8 of assembly 4 via diesel supply connection 32, diesel fuel passageway 20, and diesel fuel nozzle 12. As the diesel fuel is discharged from diesel fuel nozzle 12, it is typically atomized and sprayed into chamber 8 in a solid or hollow cone pattern.

Upon being ignited in ignition chamber 24, the gas mixture in ignition chamber 24 flows out of ignition chamber opening 58 and thereby contacts and ignites the diesel fuel being sprayed into chamber 8 via fuel nozzle 12. The resulting flame generated in chamber 8 operates to ignite the primary diesel fuel burners associated with the vaporizer burner barrel. Once the diesel burner portion of pilot burner assembly 2 is ignited, the flow of combustible gas to ignition chamber 24 is typically discontinued.

Unfortunately, prior art pilot burner assembly 2 will typically require frequent maintenance as a result of serious soot accumulation problems. In order to allow the combustible gas material used in pilot burner assembly 2 to be ignited, the gas ignition portion of burner assembly 2 is designed and positioned such that low speed turbulent air flow is maintained in ignition chamber 24. However, as a result of this design, undesirable swirling and/or vortexing air flow patterns are generated in the gas ignition area such that a substantial amount of soot accumulates in the gas ignition area. Such soot accumulation can quickly render the gas ignition system inoperable.

A substantial amount of soot accumulation will also typically occur within large diameter combustion chamber 8 and around diesel fuel nozzle 12. This soot accumulation apparently results from the presence of dead spaces within chamber 8 wherein undesirable swirling and/or vortexing flow patterns are generated.

In using pilot burner assembly 2, difficulties are also typically encountered when attempting to ignite the pilot burner at low vaporizer air fan speeds. A low fan speed will typically yield a low air turbulence level in chamber 8 such that the rate of air entry into ignition chamber 24 is relatively low. Consequently, an excessively fuel-rich mixture is produced in ignition chamber 24.

Additional difficulties have been encountered in keeping the prior art pilot burner lit at high air fan speeds. High air fan speeds are used when the vaporizer system is required to supply a high vaporized nitrogen product rate. However, high air turbulence levels produced in combustion chamber 8 at high fan speeds can produce excessively fuel lean combustible gas/air mixtures in ignition chamber 24. High localized turbulent gas speeds in chamber 8 can also operate to blow out the pilot burner flame.

Further problems have been encountered in the use of the prior art burner as a result of the conically-shaped burner flame impinging upon, and thereby burning out, portions of cylindrical combustion chamber 8.

SUMMARY OF THE INVENTION

The present invention provides a burner apparatus comprising: a liquid fuel discharge means for discharging a liquid fuel; an ignition chamber wherein an ignitable gaseous composition can be ignited to yield an ignited composition; and a gas delivery means for delivering both a gaseous, free oxygen source and a combustible gas to the ignition chamber such that the ignitable gaseous composition is provided in the combustion chamber. The ignition chamber is positioned with respect to the liquid fuel discharge means such that, upon leaving the ignition chamber, the ignited gaseous composition will ignite the liquid fuel as the liquid fuel is discharged from the liquid fuel discharge means. The gas delivery means includes an oxygen source conduit through which the free oxygen source is conducted into the ignition chamber. The gas delivery means further includes a passageway, adjacent the exterior of the oxygen source conduit, through which the combustible gas is conducted into the ignition chamber. Preferably, the gas delivery passageway substantially surrounds the oxygen source delivery conduit.

The present invention also provides a burner apparatus comprising: a combustion chamber having a passageway extending therethrough; a liquid fuel discharge means; and a holding member. The combustion chamber passageway includes a first portion and a second portion, said second portion being adjacent said first portion. The second portion of the combustion chamber passageway has an inverted frusto-conical shape which diverges away from the first portion of the combustion chamber passageway. The holding member is positionable in the first portion of the combustion chamber passageway and is operable for holding the liquid fuel discharge means. The liquid fuel discharge means is operable for discharging a liquid fuel into the second portion of the combustion chamber passageway. The holding member also includes an ignition chamber wherein an ignitable gaseous composition can be ignited to yield an ignited composition. When the holding member is positioned in the first portion of the combustion chamber passageway, the ignition chamber is positionable such that, upon leaving the ignition chamber, the ignited composition will ignite the liquid fuel in the second portion of the combustion chamber passageway.

The present invention further provides a burner apparatus comprising: a holding member having formed therein a first passageway, an ignition chamber wherein an ignitable gaseous composition can be ignited to yield an ignited composition, and a second passageway associated with the ignition chamber; an ignition means, associatable with the ignition chamber, for igniting the ignitable gaseous composition; a gas nozzle housing having an inlet port, an outlet port, and a passageway extending from the inlet port to the outlet port; and a conduit extending through at least a portion of the housing passageway and projecting through the outlet port. The gas nozzle housing has an interior wall. The conduit has an exterior wall and is positioned in the housing passageway such that an annulus exists between the interior wall of the housing passageway and the exterior wall of the conduit whereby a first fluid can be conducted into the housing inlet port, through the annulus, and out of the housing port outlet while a second fluid is separately conducted through the conduit. The first passageway of the holding member is separate from the second passageway of the holding member and from the ignition chamber. The first passageway of the holding member is associatable with a liquid fuel discharge means for discharging a liquid fuel from the first passageway. The ignition chamber is positioned in the holding member such that, upon leaving the ignition chamber, the ignited composition will ignite the liquid fuel as the liquid fuel is discharged from the discharge means.

The inventive pilot burner assembly substantially resolves the above-described soot accumulation problems encountered in the use of prior art pilot burner assembly 2. Consequently, the inventive pilot burner assembly requires much less maintenance and cleaning.

The inventive pilot burner assembly also: (a) eliminates the need to rely on combustion chamber turbulence for supplying air to the gas ignition chamber; (b) greatly reduces the effect of combustion chamber turbulence on the operation of the gas ignition chamber; (c) provides a more controlled flow of air into the ignition chamber at all air fan speeds: (d) reduces the presence of localized high turbulence zones in the combustion chamber by utilizing a combustion chamber shape which substantially matches the combustion chamber flame; and, also as a result of matching the shape of the combustion chamber with the combustion flame, (e) greatly reduces or eliminates flame impingement problems. Thus, the inventive pilot burner substantially reduces or eliminates all of the low air speed ignition, chamber wall burnout, and high fan speed blowout problems discussed hereinabove.

Further objects, features, and advantages of the present invention will be readily apparent to those skilled in the art upon reference to the accompanying drawings and upon reading the following description of the preferred embodiments.

DESCRIPTION OF THE PREFERRED EMBODIMENT

Figure 1:
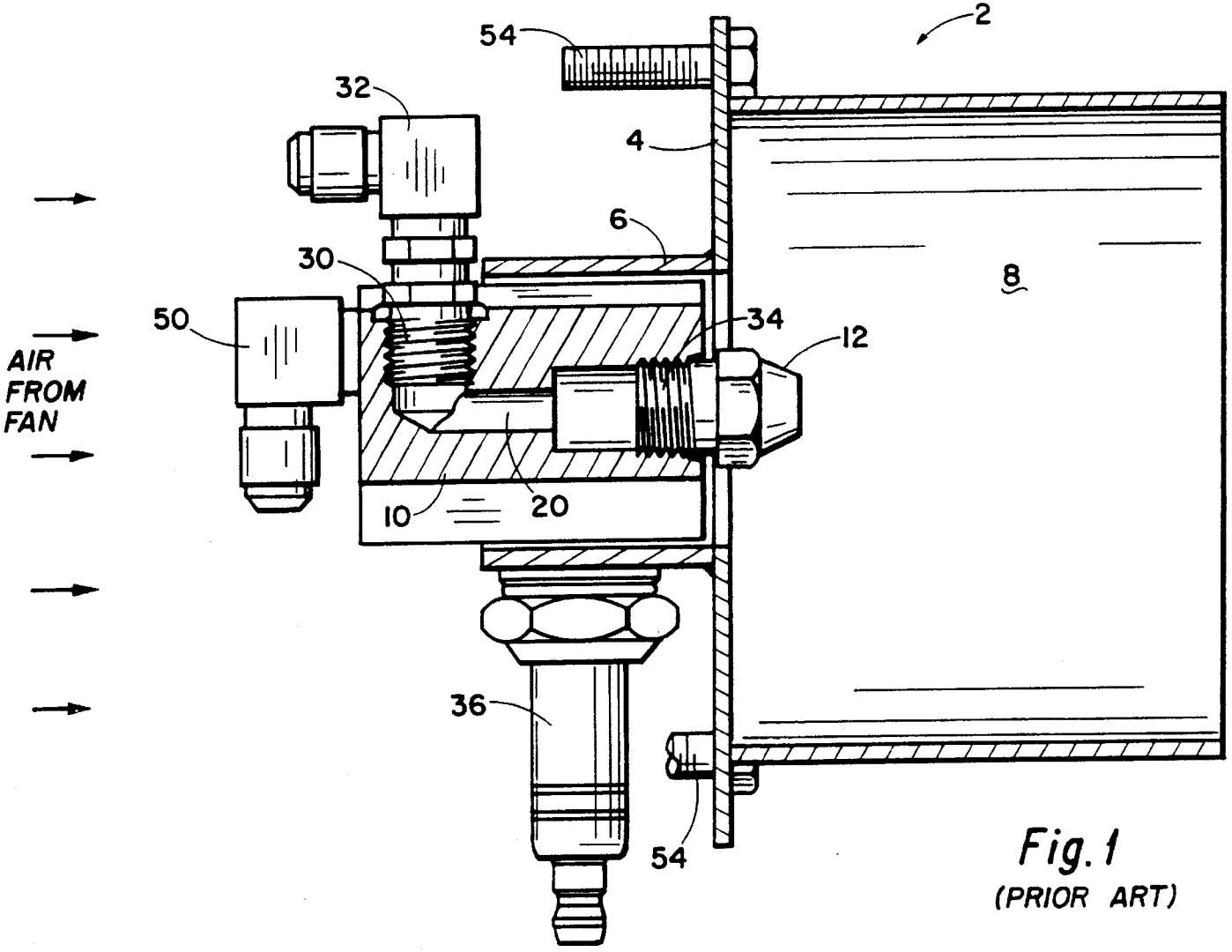
Fig. 1 (PRIOR ART)
FIG. 1 provides a cutaway side view of a prior art pilot burner assembly 2.
Figure 2:
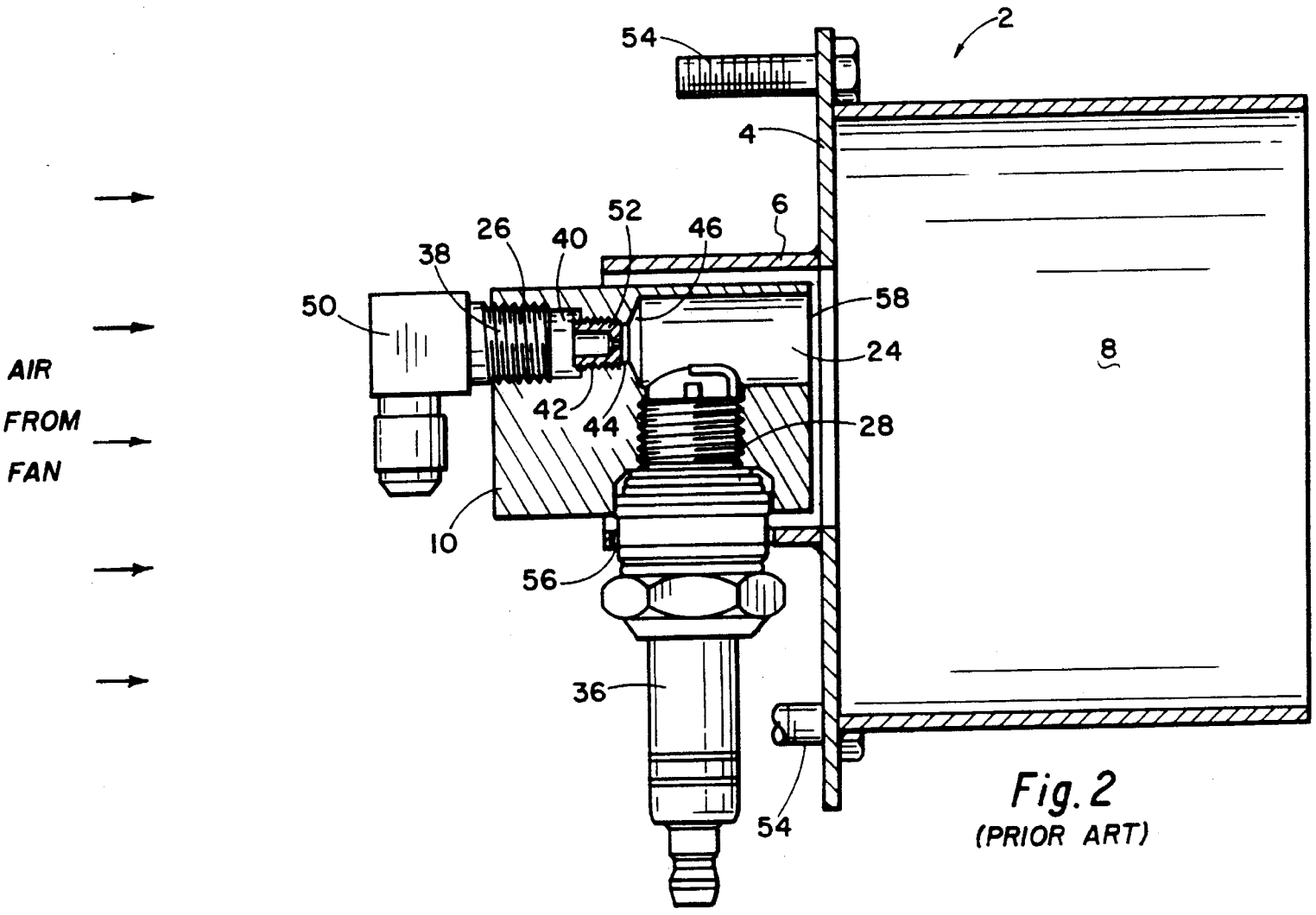
Fig. 2 (PRIOR ART)
FIG. 2 provides a second cutaway side view of prior art assembly 2.
Figure 3:
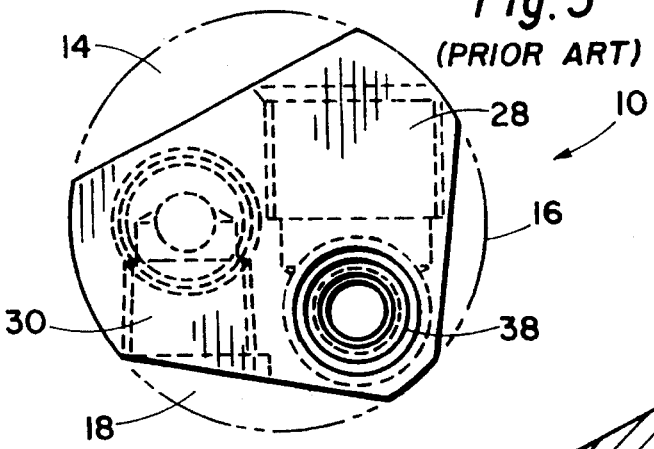
Fig. 3 (PRIOR ART)
FIG. 3 provides an end view of a nozzle holder 10 used in prior art assembly 2.
Figure 5:
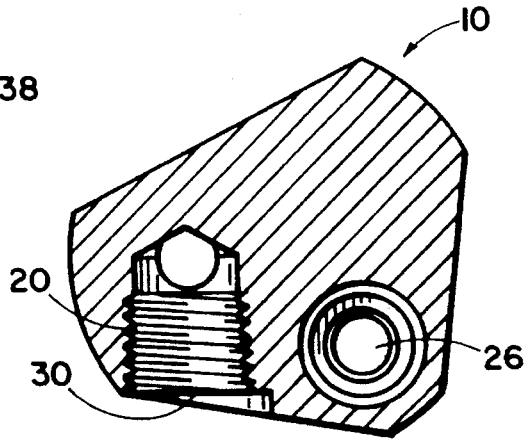
Fig. 5 (PRIOR ART)
FIG. 5 provides a cutaway view of nozzle holder 10 taken along line 5—5 shown in FIG. 4.
Figure 4:
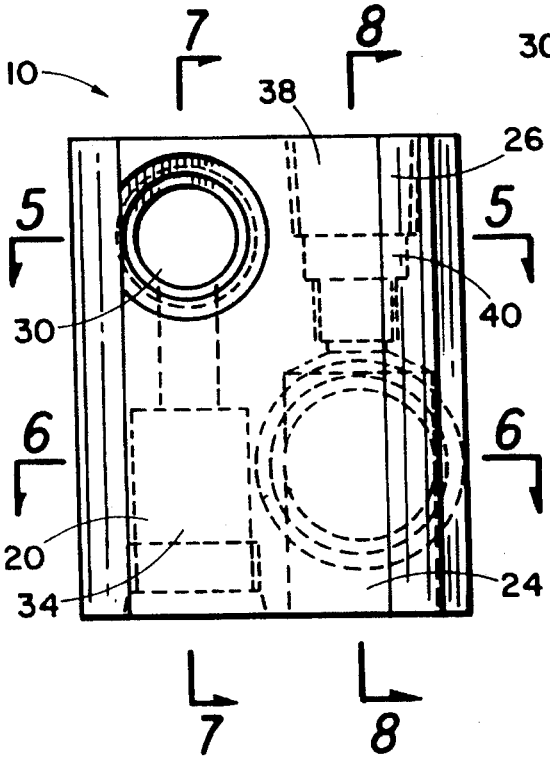
Fig. 4 (PRIOR ART)
FIG. 4 provides a side view of nozzle holder 10.
Figure 6:
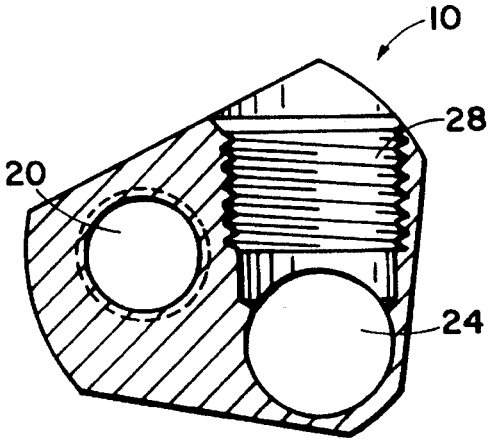
Fig. 6 (PRIOR ART)
FIG. 6 provides a cutaway view of nozzle holder 10 taken along line 6—6 shown in FIG. 4.
Figure 7:
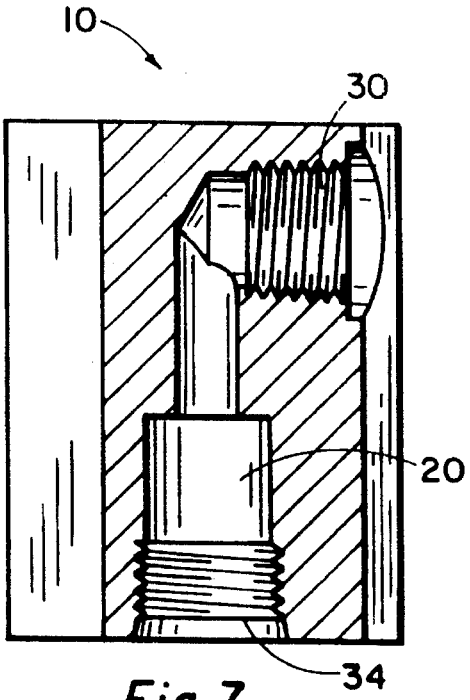
Fig. 7 (PRIOR ART)
FIG. 7 provides a cutaway view of nozzle holder 10 taken along line 7—7 shown in FIG. 4.
Figure 9:
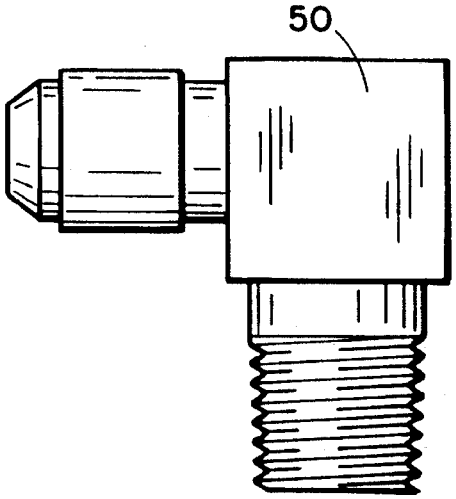
Fig. 9 (PRIOR ART)
FIG. 9 provides an elevational side view of a gas nozzle 50 used in prior art assembly 2.
Figure 8:
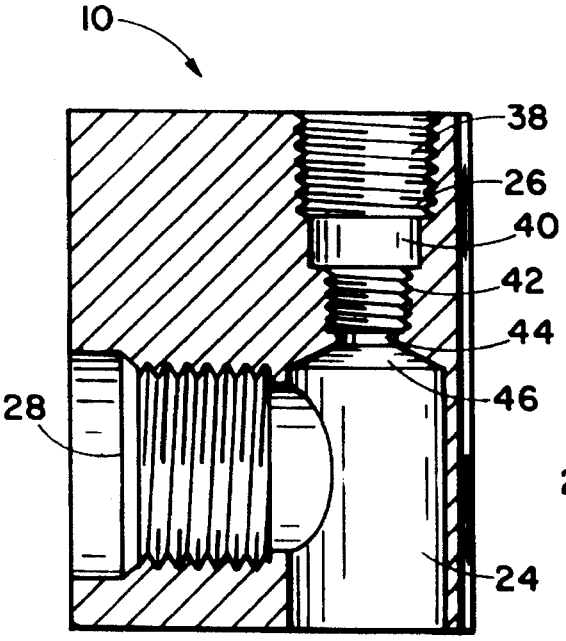
Fig. 8 (PRIOR ART)
FIG. 8 provides a cutaway view of nozzle holder 10 taken along line 8—8 shown in FIG. 4.
Figure 12:
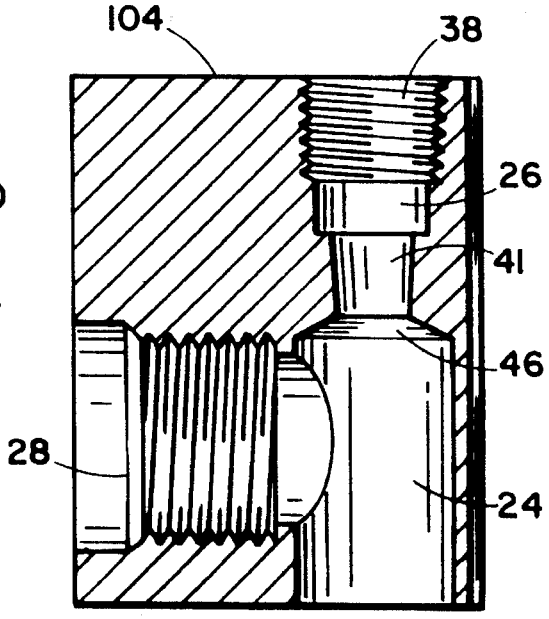
FIG. 12 provides a cutaway side view of a nozzle holder 104 used in inventive apparatus 100.
Figure 10:
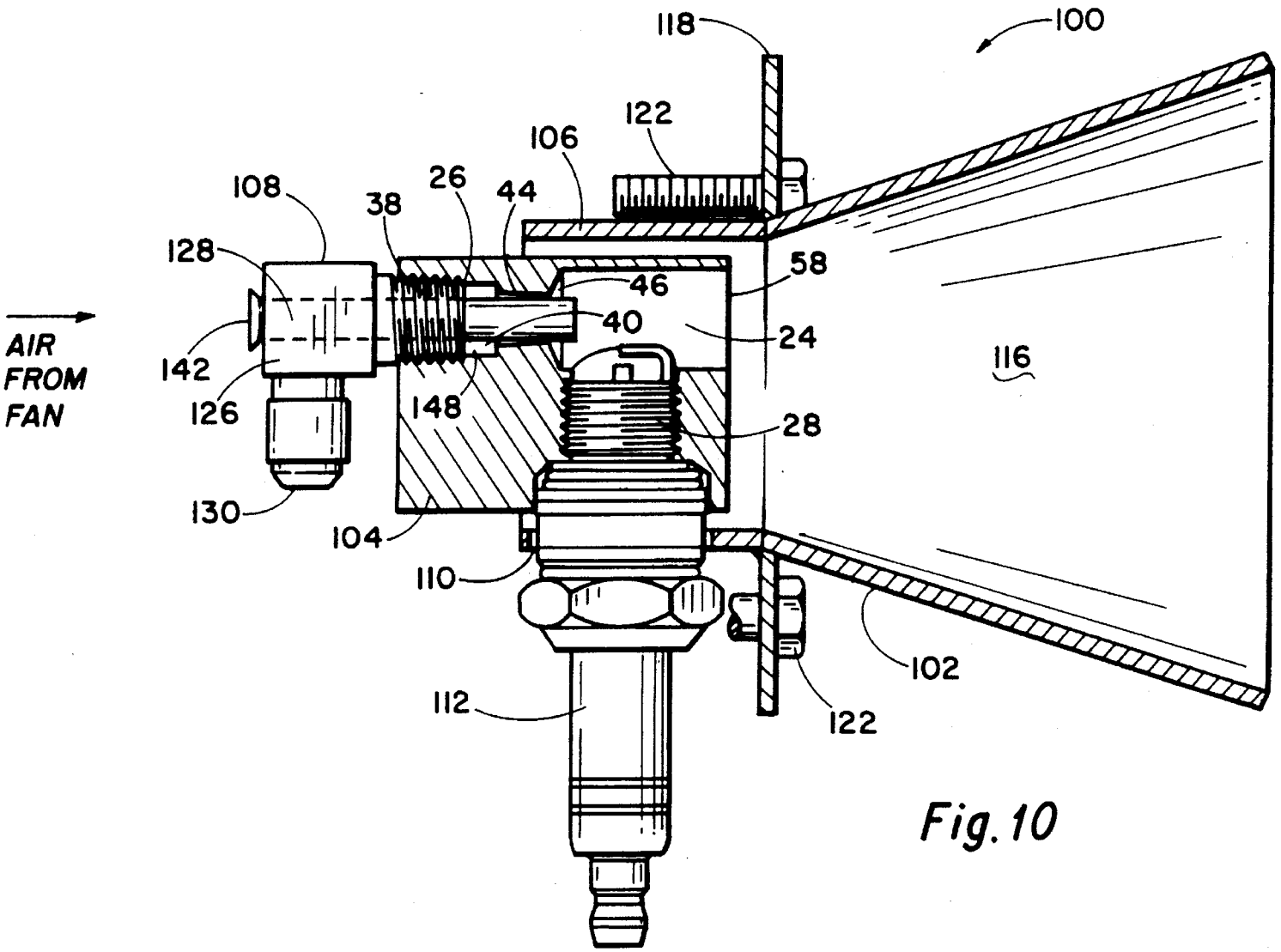
FIG. 10 provides a cutaway side view of a burner apparatus 100 provided by the present invention.
Figure 11:
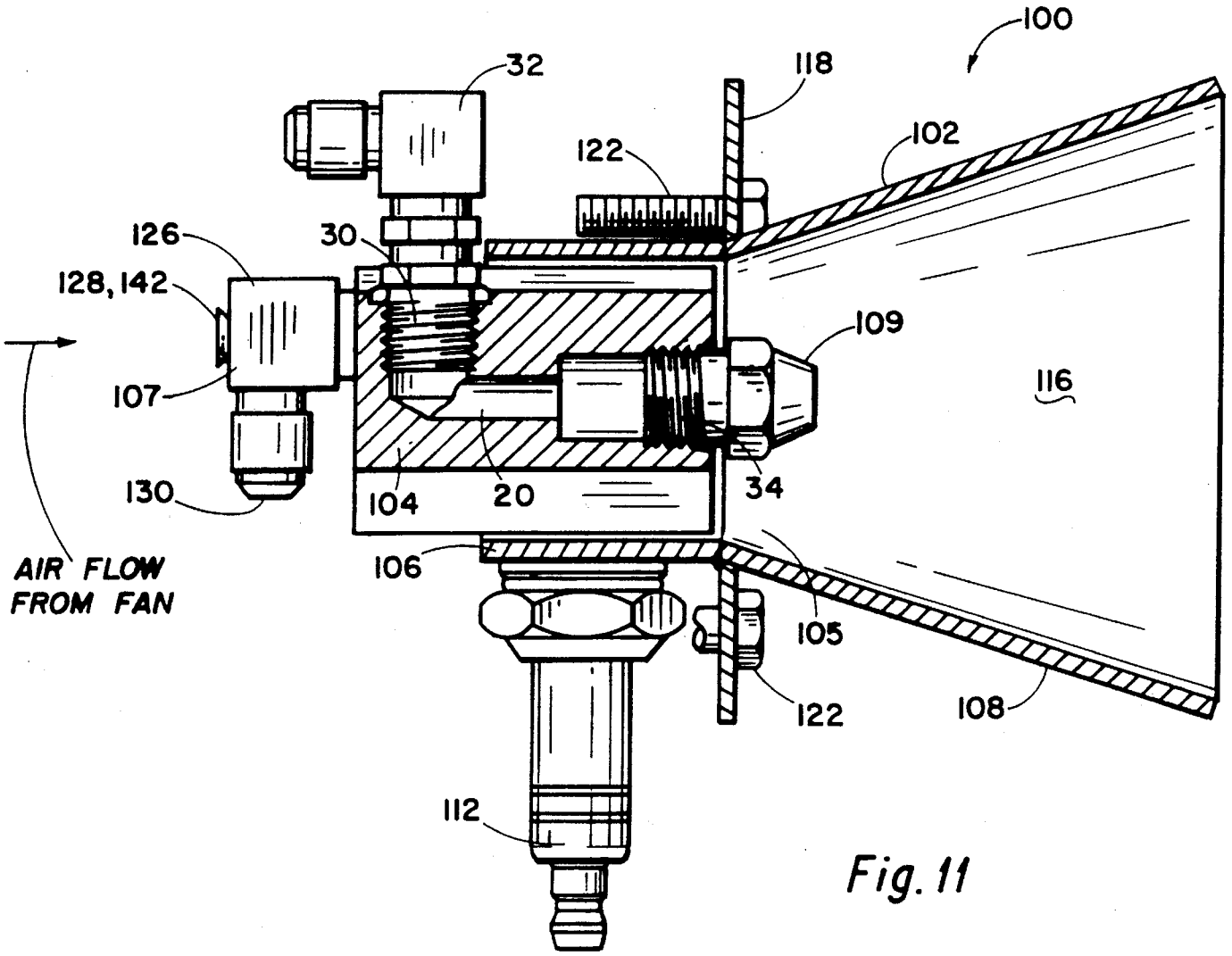
FIG. 11 provides a second cutaway side view of inventive burner apparatus 100.
Figure 14:
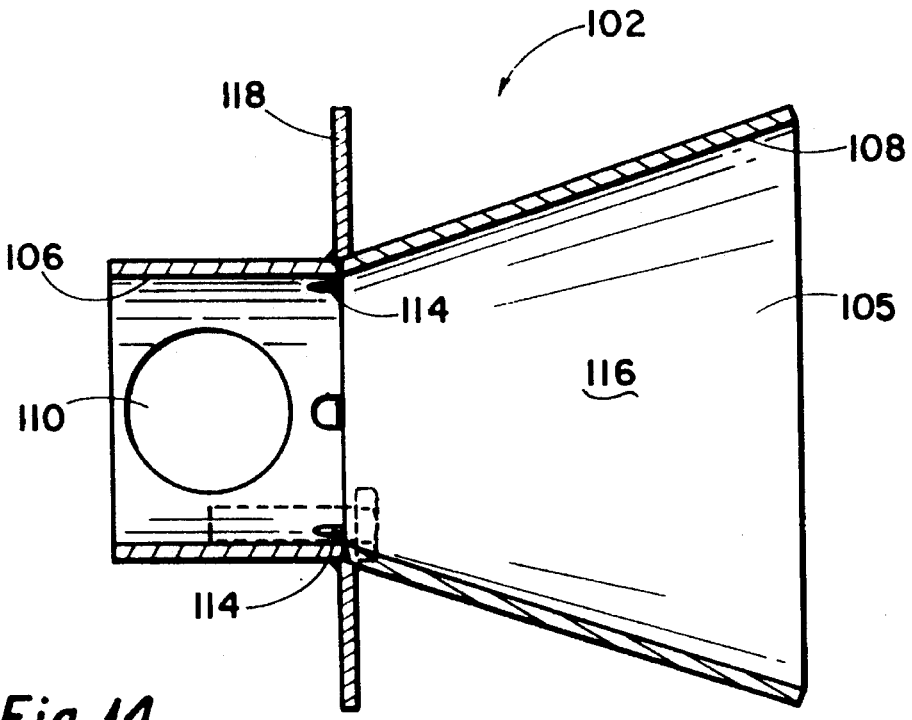
FIG. 14 provides a cutaway side view of housing 102 taken along line 14—14 shown in FIG. 13.
Figure 13:
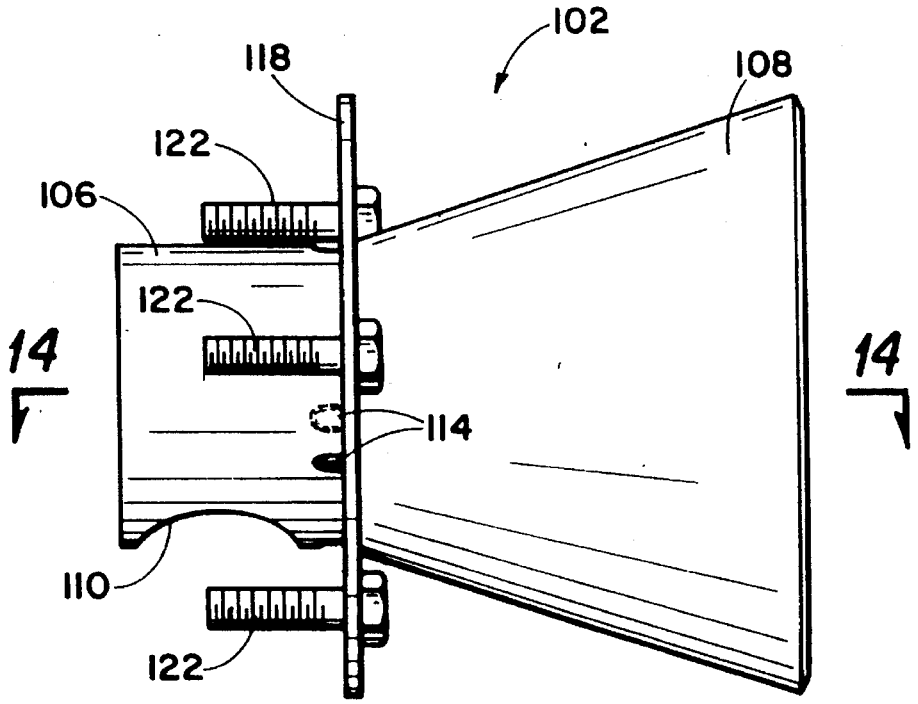
FIG. 13 provides a side view of a combustion chamber housing 102 used in inventive apparatus 100.
Figure 16:
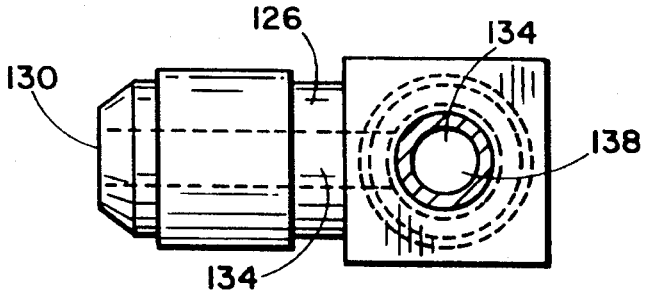
FIG. 16 provides a top view of a housing 126 used in nozzle assembly 107.
Figure 15:
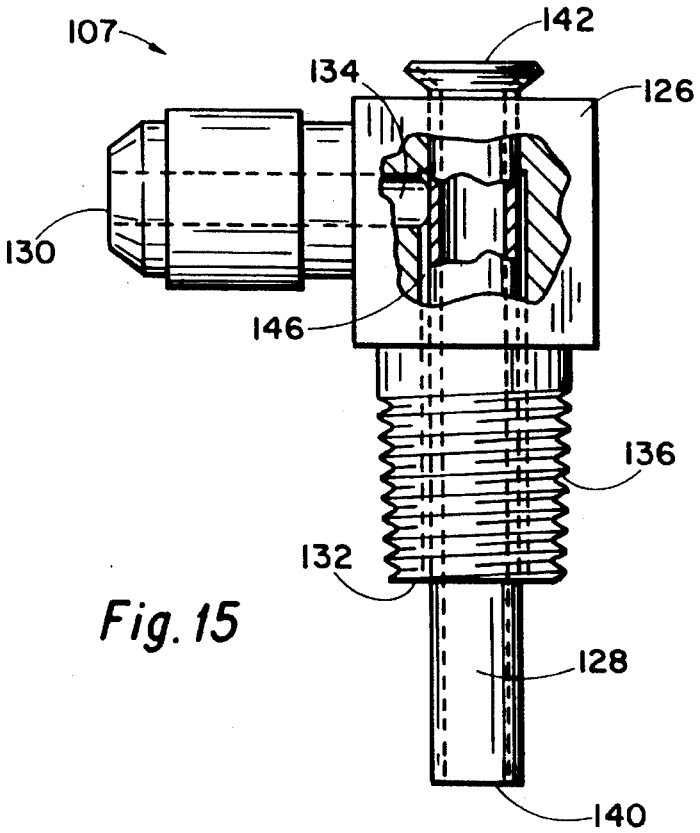
FIG. 15 provides a partially cutaway side view of a gas fuel nozzle assembly 107 used in inventive apparatus 100.
Figure 17:
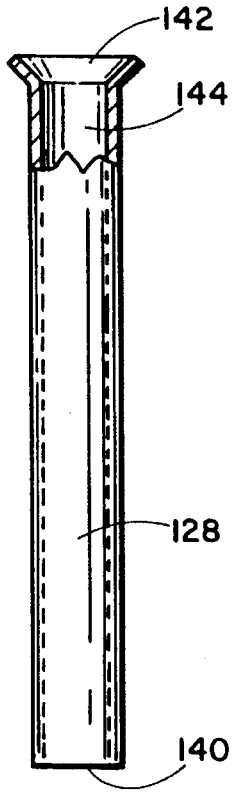
FIG. 17 provides a partially cutaway side view of an air flow conduit 128 used in nozzle assembly 107.

A burner apparatus 100 provided by the present invention is depicted in FIGS. 10 and 11. Inventive burner apparatus 100 comprises: a combustion chamber housing 102; a nozzle holder 104 which is positionable in a first part of combustion chamber housing 102; a liquid fuel nozzle 109 which is threadedly receivable in nozzle holder 104; and a gas fuel nozzle assembly 107 which is receivable in nozzle holder 104.

Combustion chamber housing 102 has a passageway 105 extending longitudinally therethrough. Combustion chamber housing 102 comprises a cylindrical chamber 106 and a frusto-conical chamber 108 adjacent chamber 106 which diverges away from chamber 106. Cylindrical chamber 106 has an interior cylindrical shape, an exterior cylindrical shape, and an aperture 110 extending through the wall thereof for receiving a spark plug 112. A plurality of ports 114 extend through the wall of cylindrical chamber 106 adjacent the frusto-conical portion 108 of housing 102 for allowing additional air flow into frusto-conical chamber 108.

The interior of frusto-conical chamber 108 of housing 102 has an inverted frusto-conical shape. The interior of frusto-conical chamber 108 provides a combustion chamber 116 wherein liquid fuel flowing from liquid fuel nozzle 109 is ignited.

A radial disk-like member 118 is preferably connected to the exterior of housing 102 at the point where cylindrical chamber 106 meets frusto-conical chamber 108. Disk-like member 118 is used for connecting housing 102 to the burner barrel wall of a nitrogen vaporizer using bolts 122.

Nozzle holder 104 is substantially identical to nozzle holder 10 described hereinabove. Consequently, those features of nozzle holder 104 which correspond to the features of nozzle holder 10 are identified using the same item numbers. Unlike nozzle holder 10, however, nozzle holder 104 does not include an orifice 52. Further, the tapered threaded bore 42 and small diameter cylindrical bore 44 of nozzle holder 10 are replaced with a smooth bore 41.

As shown in FIGS. 10 and 11, nozzle holder 104 is received in cylindrical chamber 106 of housing 102 such that spark plug 112 extends through aperture 110 of cylindrical chamber 106 and is threadedly received in spark plug port 28 of nozzle holder 104. When thus positioned, spark plug 112 prevents nozzle holder 104 from being pushed or from falling into combustion chamber 116.

Liquid fuel nozzle 109 is threadedly received in port 34 of nozzle holder 104. Liquid fuel nozzle 109 is preferably a liquid spray nozzle of the type which will operate to atomize the liquid fuel and spray the liquid fuel into combustion chamber 116 in a hollow conical pattern which substantially corresponds to the internal inverted frusto-conical shape of combustion chamber 116. As will be understood by those skilled in the art, such spray nozzles can be readily obtained from numerous commercial manufacturers.

Gas fuel nozzle assembly 107 is comprised of an L-shaped nozzle housing 126 and an elongate air flow conduit 128 which extends through a portion of nozzle housing 126. Nozzle housing 126 includes an inlet port 130, an outlet port 132, a passageway 134 extending from inlet port 130 to outlet port 132, an externally threaded portion 136 surrounding outlet port 132, and an aperture 138 which extends through the wall of nozzle housing 126 and is positioned directly above outlet port 132.

Elongate air flow conduit 128 includes an air outlet end 140, a flared air inlet end 142, and an air flow passageway 144 extending from inlet end 142 to outlet end 140. Air flow conduit 128 is receivable in aperture 138 of nozzle housing 126 such that flared inlet end 142 abuts the exterior surface of nozzle housing 126. The air outlet end 140 of conduit 128 projects from outlet port 132 of nozzle housing 126 and an annulus 146 surrounding air flow conduit 128 is defined by a gap between the exterior surface of air flow conduit 128 and the interior wall of nozzle housing passageway 134.

The externally threaded portion 136 of gas nozzle housing 126 is threadedly received in the gas passageway inlet port 38 of nozzle holder 104. When the gas nozzle housing 126 is thus received in nozzle holder 104 and air flow conduit 128 is fully received in aperture 138 of gas nozzle housing 126, the air outlet end 140 of air flow conduit 128 projects into the inlet 46 of ignition chamber 24. Additionally, the internal diameters of cylindrical bore 40 and bore 41 formed in nozzle holder passageway 26 are all greater than the external diameter of air flow conduit 128 such that a combustible gas flow passageway 148 surrounding air flow conduit 128 is defined by a gap between the exterior surface of air flow conduit 128 and the interior surfaces of cylindrical bore 40 and bore 41.

When inventive burner apparatus 100 is assembled and placed in operation, the vaporizer air fan operates to increase the air pressure at flared inlet 142 of air flow conduit 128 such that air from the vaporizer air fan flows directly into flared inlet 142. This air then flows through passageway 144 of air flow conduit 128, out of end 140, and into ignition chamber 24. At the same time, a combustible gas (e.g., propane) is separately delivered to ignition chamber 24 via nozzle housing inlet port 130, annulus 146, and gas flow passageway 148. The resulting air/combustible gas mixture formed in ignition chamber 24 is ignited by spark plug 112. The flow of combustible gas into the ignition chamber surrounding the air flow stream creates an eductor effect which promotes the thorough mixing of the fuel stream and the air stream. Additionally, a proper fuel/air ratio can be ensured at any fan speed by externally adjusting the fuel flow rate.

As the air/combustible gas mixture is ignited in ignition chamber 24, a liquid fuel (e.g., diesel) is sprayed into combustion chamber 116 via liquid fuel nozzle 109. The ignited gaseous composition formed in ignition chamber 24 flows from the ignition chamber into combustion chamber 116 wherein the ignited gaseous material operates to ignite the liquid fuel being sprayed from nozzle 109. The ignited liquid fuel in turn operates to ignite the primary burners of the nitrogen vaporizer apparatus.

Once the liquid fuel flowing from nozzle 109 is ignited in chamber 116, the flow of combustible gas to ignition chamber 24 can be discontinued. However, air from the vaporizer fan will continue to flow through air flow conduit 128 and into ignition chamber 124. This continuous air flow operates to purge the ignition chamber such that soot accumulation in the gas ignition system is minimized.

As with pilot burner assembly 2, a substantial amount of the air required for combustion in combustion chamber 116 is blown by the vaporizer air fan through cylindrical housing chamber 106 via the openings supplied by cutaway portions 14, 16, and 18 of nozzle holder 104. However, in the inventive apparatus, air also flows into combustion chamber 116 via ports 114 formed through the wall of cylindrical chamber 106. The flow of air through ports 114 creates a lateral shearing-type flow regime at the entrance of combustion chamber 116. This lateral shearing-type flow regime operates to purge the area around the liquid fuel nozzle and thereby minimize the accumulation of soot on and around the liquid fuel nozzle.

In conjunction with the lateral flow of air through ports 114, the inverted frusto-conical shape of combustion chamber 116 functions to minimize the presence of dead air spaces in combustion chamber 116 and thereby reduces soot accumulation. This result is primarily achieved because, as mentioned above, the inverted frusto-conical shape of combustion chamber 116 substantially corresponds to the conical spray pattern generated by liquid fuel nozzle 109. Additionally, the inverted frusto-conical shape of combustion chamber 116 substantially corresponds to the expanding combustion material flow pattern produced in combustion chamber 116 as a result of the ignition and combustion of the liquid fuel.

As indicated above, the inverted frusto-conical shape of combustion chamber 116 also serves to provide more stable operation at high air speeds. The large void spaces in the combustion chamber of prior art pilot burner assembly 2 can produce a substantial amount of turbulence within the combustion chamber when high air speeds are used. This turbulence renders the prior art burner assembly unstable and can operate to extinguish the liquid fuel flame. In contrast to prior art assembly 2, however, the inverted frusto-conical shape of combustion chamber 116 of inventive apparatus 100 minimizes the presence of such void spaces. Consequently, the liquid fuel flame generated in the inventive apparatus remains stable even at high air speeds.

As further indicated above, the inverted frusto-conical shape of combustion chamber 116 greatly improves the stability and consistency of the combustible gas/air mixture used in the ignition chamber and alleviates combustion chamber burnout problems caused by flame impingement.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A burner apparatus for use in a burner system, said burner system including a fuel burning chamber and an air blower positioned outside of said fuel burning chamber such that said air blower is operable for blowing an air stream toward said fuel burning chamber, said burner apparatus comprising:

a gas nozzle housing having a housing passageway provided therein extending from a passageway inlet to a passageway outlet, said housing passageway having an interior wall, a conduit having an inlet end and an outlet end, said conduit extending through at least a portion of said housing passageway such that said outlet end of said conduit projects from said passageway outlet, said conduit having an exterior wall, and a holding means including an ignition chamber wherein an ignitable gaseous composition can be ignited and a holding means passageway communicating with said ignition chamber, said gas nozzle housing being connected to said holding means such that said passageway outlet of said gas nozzle housing is positioned in said holding means passageway and said outlet end of said conduit extends into said ignition chamber, wherein said conduit is positioned in said housing passageway such that an annulus is provided between said interior wall of said housing passageway and said exterior wall of said conduit, and wherein said inlet end of said conduit is open such that, when said burner apparatus is installed in said burner system at a position within said air stream, a portion of said air stream will flow into said inlet end of said conduit.

2. The burner apparatus of claim 1 wherein said inlet end of said conduit is flared.

3. The burner apparatus of claim 1 wherein said gas nozzle housing is a substantially L-shaped member having a wall opposite said passageway outlet of said gas nozzle housing and said conduit extends through said wall.

4. The burner apparatus of claim 1 wherein said outlet end of said conduit is substantially circular.

5. A burner apparatus for use in a burner system, said burner system including a fuel burning chamber and an air blower positioned outside of said fuel burning chamber such that said air blower is operable for blowing an air stream toward said fuel burning chamber, said burner apparatus comprising:

a burner housing having a passageway extending therethrough, said passageway including a first portion and a fuel combustion portion extending from said first portion, said fuel combustion portion having a first end adjacent to said first portion;

a holding member having a first end and a second end, said holding member having formed therein: a first passageway; an ignition chamber wherein an ignitable gaseous composition can be ignited to yield an ignited composition, said ignition chamber having an open end at said second end of said holding member; and a second passageway communicating with said ignition chamber, said first passageway of said holding member being separate from said second passageway of said holding member;

a liquid fuel discharge nozzle connected to said second end of said holding member such that said liquid fuel discharge nozzle is operable for receiving a liquid fuel from said first passageway formed in said holding member and said liquid fuel discharge nozzle is operable for discharging said liquid fuel into said fuel combustion portion of said burner housing;

a gas nozzle housing having an inlet port, an outlet port, and a passageway extending from said inlet port to said outlet port, said gas nozzle passageway having an interior wall;

a conduit having an inlet end and an outlet end, said conduit extending through at least a portion of said gas nozzle housing passageway such that said outlet end of said conduit projects from said outlet port, said conduit having an exterior wall;

said gas nozzle housing being connected to said holding member such that said outlet port is positioned in said second passageway of said holding member;

said conduit being positioned in said gas nozzle passageway such that an annulus is provided between said interior wall of said gas nozzle passageway and said exterior wall of said conduit such that a combustible gas can be conducted into said inlet port, through said annulus and then out of said outlet port, said outlet end of said conduit extending into said ignition chamber, and said inlet end of said conduit being open to the atmosphere such that a first portion of said air stream blown by said air blower toward said fuel burning chamber flows into said inlet end of said conduit.

6. The burner apparatus of claim 5 wherein said inlet end of said conduit is flared.

7. The burner apparatus of claim 5 further comprising an ignition means, at least a first portion of said ignition means being positionable in said ignition chamber, for igniting said ignitable gaseous composition in said ignition chamber.

8. The burner apparatus of claim 7 wherein said ignition means is a spark plug.

9. The burner apparatus of claim 5 wherein said burner housing further includes a plurality of apertures extending through the wall of said burner housing at about said first end of said fuel combustion portion such that a second portion of said air stream blown by said air blower toward said fuel burning chamber will flow into said apertures and create a lateral shearing-type flow regime in said fuel combustion portion.

10. The burner apparatus of claim 9 wherein said fuel combustion portion of said burner housing has an inverted frusto-conical shape such that said fuel combustion portion diverges away from said first portion of said burner housing.

11. The burner apparatus of claim 5 wherein said gas nozzle housing is a substantially L-shaped member having a wall opposite said outlet port and said conduit extends through said wall opposite said outlet port.

12. The burner apparatus of claim 5 wherein said outlet end of said conduit is substantially circular.

* * * * *